US005694374A

United States Patent [19]

Ripoll et al.

[11] Patent Number: 5,694,374

[45] Date of Patent: Dec. 2, 1997

[54] PROCESS AND DEVICE TO REDUCE THE RESONANT FREQUENCY OF THE CAVITIES OF THE SUBMERSIBLE TRANSDUCERS

[75] Inventors: Yves Y. Ripoll; Jacky J. Garcin, both of Six Fours les Plages, France

[73] Assignee: L'Etat Francais represente par le Delegue General pour l'Armement, Paris, France

[21] Appl. No.: 603,363

[22] Filed: Feb. 20, 1996

[30] Foreign Application Priority Data

Feb. 23, 1995 [FR] France ..... 95 02093

[51] Int. Cl.[6] ..... H04R 17/00

[52] U.S. Cl. ..... 367/162; 367/158; 367/176; 310/337

[58] Field of Search ..... 367/158, 162, 367/176; 310/337, 326

[56] References Cited

U.S. PATENT DOCUMENTS

| | | | |
|---|---|---|---|
| 5,130,953 | 7/1992 | Grosso | 367/155 |
| 5,363,345 | 11/1994 | Boucher et al. | 367/162 |
| 5,483,502 | 1/1996 | Scarpitta et al. | 367/158 |

FOREIGN PATENT DOCUMENTS

| | | |
|---|---|---|
| 0 462 037 | 12/1991 | European Pat. Off. . |
| 2 665 998 | 2/1992 | France . |

OTHER PUBLICATIONS

La tomographie acoustique des oceans —Robert Spindel & Peter Worcester, Pour La Science No. 150 Dec. 1990 —pp. 66–72.

*Primary Examiner*—Ian J. Lobo
*Attorney, Agent, or Firm*—Oliff & Berridge

[57] ABSTRACT

The invention is directed to the class of submersible electro-acoustic transducers such as double "Tonpilz" transducers, wherein it is desirable to reduce the resonant frequency of the transducers while maintaining a given output power emitted by the transducers. The transducer according to the invention includes at least one horn solid with the end of a motor pillar, a hollow rigid box surrounding the horn and delimiting with the horn a cavity. The cavity communicates via a port with an external fluid, and has determined dimensions and external volume. The transducer further includes a passive radiator made of a material denser than the external fluid. The radiator obturates the port and hangs at a periphery of the port by an elastic material.

10 Claims, 3 Drawing Sheets

PROCESS AND DEVICE TO REDUCE THE RESONANT FREQUENCY OF THE CAVITIES OF THE SUBMERSIBLE TRANSDUCERS

BACKGROUND OF THE INVENTION

1. Field of Invention

The present invention relates to processes and devices for reducing the resonant frequency of the cavities of the submersible transducers.

The technical sector of the invention is that of the realisation of a submersible electro-acoustic transducer.

The main application of the invention is the reduction of the resonant frequency for the so-called double "Tonpilz" transducers and in particular for those used for emitting high efficiency acoustic waves and around a given direction plane and omnidirectionally according to this plane.

2. Background of the Invention

Such submersible electro-acoustic transducers are known, and in particular piezo-electric ones, comprising a hollow, rigid cylindrical box open at both axial ends, and inside which two identical electro-acoustic motors are arranged coaxially with the latter, located on both sides of a central counter-mass and the opposite ends of which are surrounded by a horn. Such transducers are called double "Tonpilz". The said electro-acoustic motors can be embodied with by two aligned stacks of piezo-electrical plates. The outer faces of the two horns are located in the plane of the axial ends of the box, so that they are in contact with the liquid in which the box is immersed, and the external perimeter of these horns comes as close as possible to the edge of the open axial ends of the said box.

So, these outer faces emit acoustic waves into the liquid when the electro-acoustic motors are excited electronically; these transducers are used notably for emitting low frequency acoustic waves into water in a determined direction; for an application of this mono or double "Tonpilz" transducer to high power emissions, application FR. 2.663,182 by Mr Gilles GROSSO published on Dec. 13, 1991 can be mentioned, which describes complementary devices to obtain increased power.

In order to avoid the propagation of the acoustic waves emitted by the rear faces of the horns, inside the box, especially when the latter is in fact filled with liquid, and which are then retransmitted into the ambient medium despite the rigidity of the said box, various means such as elastic tubes that are closed, sealed and filled with gas and located in the cavity filled with ambient liquid at the rear of the horns of such unsealed boxes, and such that the Helmholtz resonant frequency of the cavity is near the fundamental frequency of the axial vibrations of the vibrating assembly; such a device is described in patent application FR. 2.665.998 of May 5, 1988 filed by Etat Francais General Delegate for the Armament. Thus, the problem of the resistance of the external box to pressure is transferred to the resistance of the said elastic tubes, which, having a smaller diameter, make the assembly less heavy; other means can be developed in the same objective and apply to the present invention, since these devices require keeping a cavity, at the rear of the horns, with sufficient dimensions.

Moreover, when, according to the objectives of the present invention one wants to reduce the low frequency of use of such transducers under 500 hz while increasing if possible or at least keeping the same electro-acoustic efficiency and the power actually emitted, it is necessary to reduce the resonant frequencies of the motor and resonator.

If other means can be developed and are concerned by other patent applications, as regards the reduction of the resonant frequency of the motor, the characteristics of these means can however be combined with that essential and principal of the present invention such as it will be described later, for the reduction of the frequency of resonance of the resonator.

To do so, it would be possible, and to date this is known, to increase the horn mass as well as the dimensions of the rear cavity of the latter and/or the number of compliant tubes as described and indicated above, but such solutions charge and increase the total volume of the transducer, then requiting more acoustic power. Depending on the applications, above all for the ones for which the volume of energy storage is critical and whose transducer must be autonomous over long periods, such solutions are not then satisfactory.

The main problem posed is therefore to be able to reduce the resonant frequency of the resonator, i.e. that of the resonant cavities of a transducer, in particular of the double "Tonpilz" type without increasing its dimensions and weight starting from a standard transducer of the same type, and with at least the same acoustic power for the same maximum power consumption.

SUMMARY OF THE INVENTION

A solution to the problem posed is a process of emission of acoustic waves into a fluid, at low frequency, from a transducer comprising at least one horn solid with the end of a motor pillar, a hollow rigid box surrounding the said horn and delimiting with the latter at least one cavity communicating by at least one opening with the said external fluid, which can thus fill it also, and with determined dimensions and volume, the said transducer transmitting waves in a given range of frequency and at a given electro-acoustic power; the process according to the invention is then such that:

- the said opening is obturated by a passive radiator whose definition is explained hereafter, made of a material denser than the said fluid;
- the said passive radiator is hung at the periphery of the said opening by an elastic material;
- acoustic waves are emitted at frequencies lower than that of the given initial range of frequency and with the same maximum power consumption.

In an embodiment for a double "Tonpilz" transducer, a peripheral opening is made in the wall of the said transducer box between its two said horns, thus making one of the said opening of communication between the said external fluid and the internal cavity located between these horns;

- this opening is obturated by a passive radiator made of several independent sectors and connected to each other by elastic connections.

Moreover, as indicated previously, if one also wants to reduce the resonant frequency of the transducer motor and thus be able to increase the acoustic efficiency of the latter and then allow the increase of the acoustic power for a same given power consumption, a dynamic load solid with the said horn is placed at the rear face of the said horn inside the said box, partially closing its internal section and dividing the said internal cavity into two communicating parts, a rear one and a front one, and the peripheral external edge of the horns are moved near the internal box wall preferably at a distance a few tenths of a millimetre.

Preferably, the said embodied transducer is used in a frequency range surrounding that of the rear cavity thus delimited by the said dynamic load: the definition and a type of embodiment of the latter is given in the following description.

It has thus been possible to generate a sound signal of approximately 200 db at the frequency of 300 hz without increasing the volume of the cavity nor the number of compliant tubes in the latter as it has been done up until now from a known double "Tonpilz" transducer, without cavity in front of the horns as described below. Moreover, by using simultaneously a dynamic load which reduces the motor frequency without increasing the mass of the horns for a same sound level, the mechanical constraints applied on the ceramics of these motors are reduced and also the power consumption.

Indeed, the presence of the said dynamic load makes it possible to indirectly increase the horn mass by association of the mass of liquid located between the latter and the said dynamic load; since this latter only partially closes the internal section of the box, the liquid can however go from the so-called front cavity to the rear cavity while being slowed down according to the surface ratio between the free surface of the conduit left by the said dynamic load and the total internal surface of the box: thus, a virtual mass of the horn is obtained all the more important as this surface ratio is high.

In a particular embodiment, when one wants to use a transducer according to the invention and of the double "Tonpilz" type for also emitting with a high efficiency and preferably around a given direction plane and omnidirectionally in this plane, the said previously defined rigid box, which is cylindrical with an axis XX' is prolonged, and encloses the two electro-acoustic motors, each of them being associated with one horn, beyond the latter and in axis XX'; thus two cavities are made which comprise an axial end opening in front of the horns and whose resonance is determined in order to correspond to the wanted emission frequency range ;then the part of the box located between the said two horns is closed and encloses a central cavity and the two end openings of the said box are obturated, by a passive radiator.

Thus, one of the main applications of this latest embodiment is the possibility of emitting and/or receiving high efficiency acoustic waves in horizontal planes to study by layers or by sections the various properties of the oceans, such as temperature, salinity, density, currents, etc . . . , to understand the phenomena and their fluctuation with the time.

An issue of the magazine "Pour la Science" No. 158 of December 1990, pages 66 and following, presented by Messrs Robert SPINDEL and Peter WORCESTER describes such an application, the equipment and measurements obtained up until now in this field.

For this purpose, a technique called "ocean acoustic tomography" has been developed to generate a tridimensional image of the area crossed by sound waves, as it is done in medicine with X-ray beams, or in the geology of the earth crust with seismic waves: in the oceanic field, low frequency acoustic waves are used.

By adapting the resonance of the said cavities thus created in the embodiment such as described in FIG. 4 to that of the emission frequencies by means of various embodiments such as described in the enclosed drawings, it is possible to obtain an efficiency of 90 to 95% of the consumed power, above all in the low frequencies from 100 to 500 hz, but the efficiency is also improved in high frequencies.

Moreover, if one wants to obtain an effective directivity, the said rigid box is prolonged in its total length to be approximately the half, Give or take 20%, i.e. in fact 0.8 to 1.2 times half the wave length of the acoustic waves emitted by the transducer. The further one is from the accurate wave half-length, the more significant the lobes of emission emitted in the axis of the transducer and not in the direction plane wanted, but this loss of emission in a useless axis does not represent very much power if the above tolerances are complied with.

To obtain the wanted resonance of the cavities, such as described more precisely below, the latter can enclose either closed elastic tubes, sealed and filled with gas, or at least one flexible bladder occupying part of its volume and filled with a fluid more compressible than the liquid of immersion: the advantage of the presence of such tubes called compliant and/or a bladder is also a greater efficiency and the attenuation of the frequencies between the two peaks of the resonance belonging to the transducer, one of them being linked to the mechanical resonance of the whole transducer, and the other to that of its cavity.

The result is new processes and transducers which can be equipped with devices according to the invention for emitting acoustic waves into a liquid with the main objective of reducing the emission frequency without increasing the volume and weight of known transducers the same horns and electro-acoustic motors of which are used: beyond this objective and according to the application sought after it is then also possible to improve the acoustic efficiency and obtain a certain directivity by combining various devices according to the invention as indicated above and described below.

It would be possible to mention other advantages of the present invention but those mentioned above show enough to prove the novelty and interest. The following description and figures show an example of embodiment of the invention but they have no limiting character: other realisations are possible within the framework of this invention range of extent, in particular by changing the shape of the dynamic load such as represented in dots as an example on the left hand side in FIG. 1.

BRIEF DESCRIPTION OF THE DRAWINGS

The invention will be described in detail with reference to the following drawings, wherein like reference characters refer to like elements and.

DETAILED DESCRIPTION OF THE INVENTION

First of all we note that the present invention can apply to all types of submersible transducers comprising at least one horn and one motor pillar, even if in the above and further mentioned examples, to simplify the description and taking into account the fact that they are the main applications of the invention, only horns coupled to electro-acoustic motors of double "Tonpilz" type transducers with a cylindrical form of revolution are described.

Figure 1:
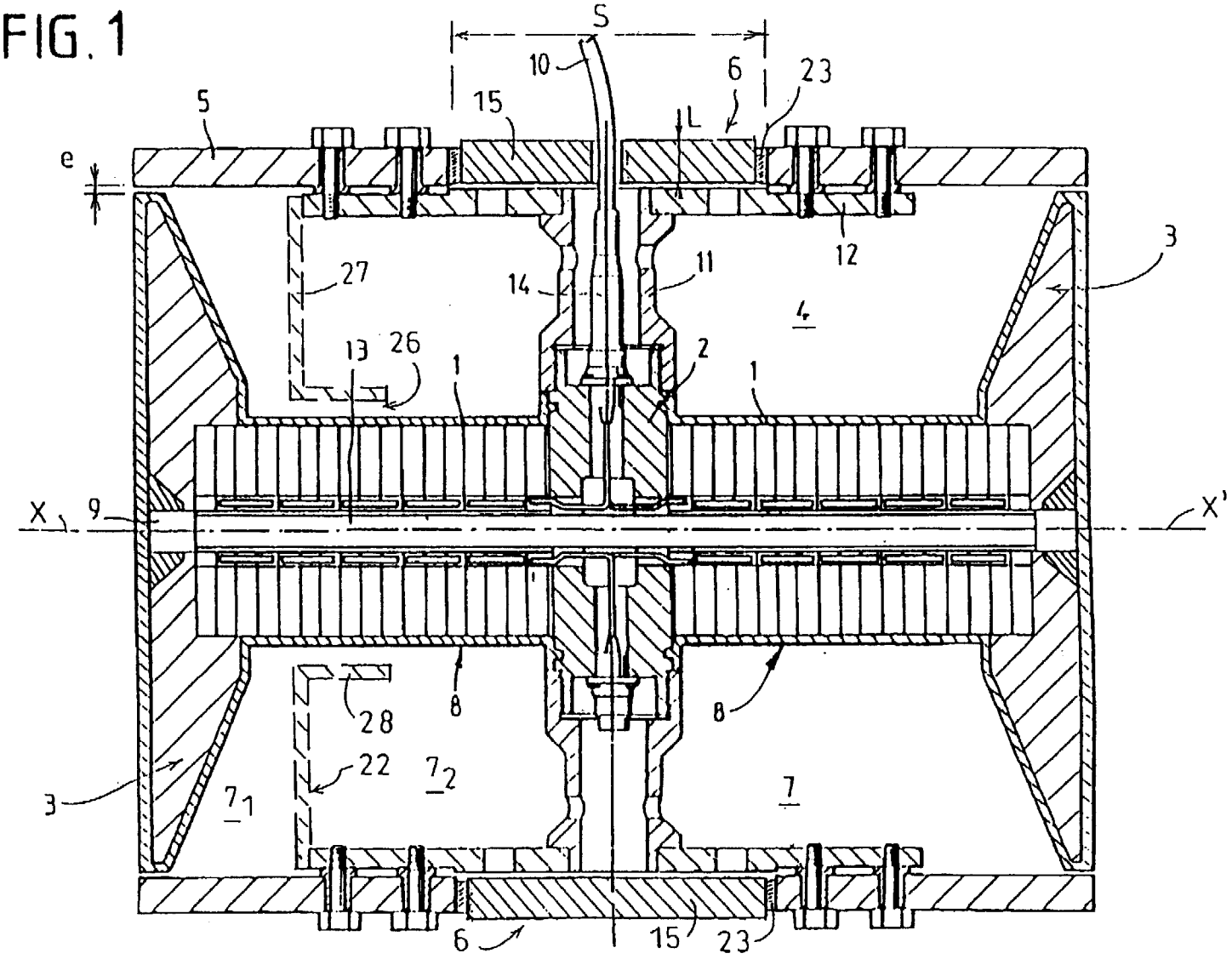
FIG. 1 is an axial cutaway view of a transducer of the type previously indicated with a central cavity open to the outside and defined below equipped with a passive radiator according to the invention.

The transducer as represented in cross sectional view in FIG. 1 comprises therefore in a known manner, two electro-acoustic motors 1 in line on an axis XX', located on both sides of a central counter-mass 2 and coaxially inside a cylindrical box 5, which can be called external, covering all the said motors 1 up until end horns 3 of the latter, cavity 7, thus delimited by the said horns and the said box being filled with liquid in which the whole transducer is submersed, such as sea water.

The said electro-acoustic motors 1 and intermediate mass 2 are on the one hand, held together by a preconstraint rod 9, also immobilising both constituted horns 3 on the extremities of the pillar, and on the other hand, assembled with various connecting parts 11, which are associated to various fastening parts 12 to external box 5. The various fastening means are such that they allow a movement of the extremities of the electro-acoustic motors on the side of horns 3, which are solid with them and whose peripheral external edge 16, not connected and independent of the internal wall of box 5, can then vibrate freely in order to ensure the full emission of acoustic waves in the ambient medium.

Figure 4:
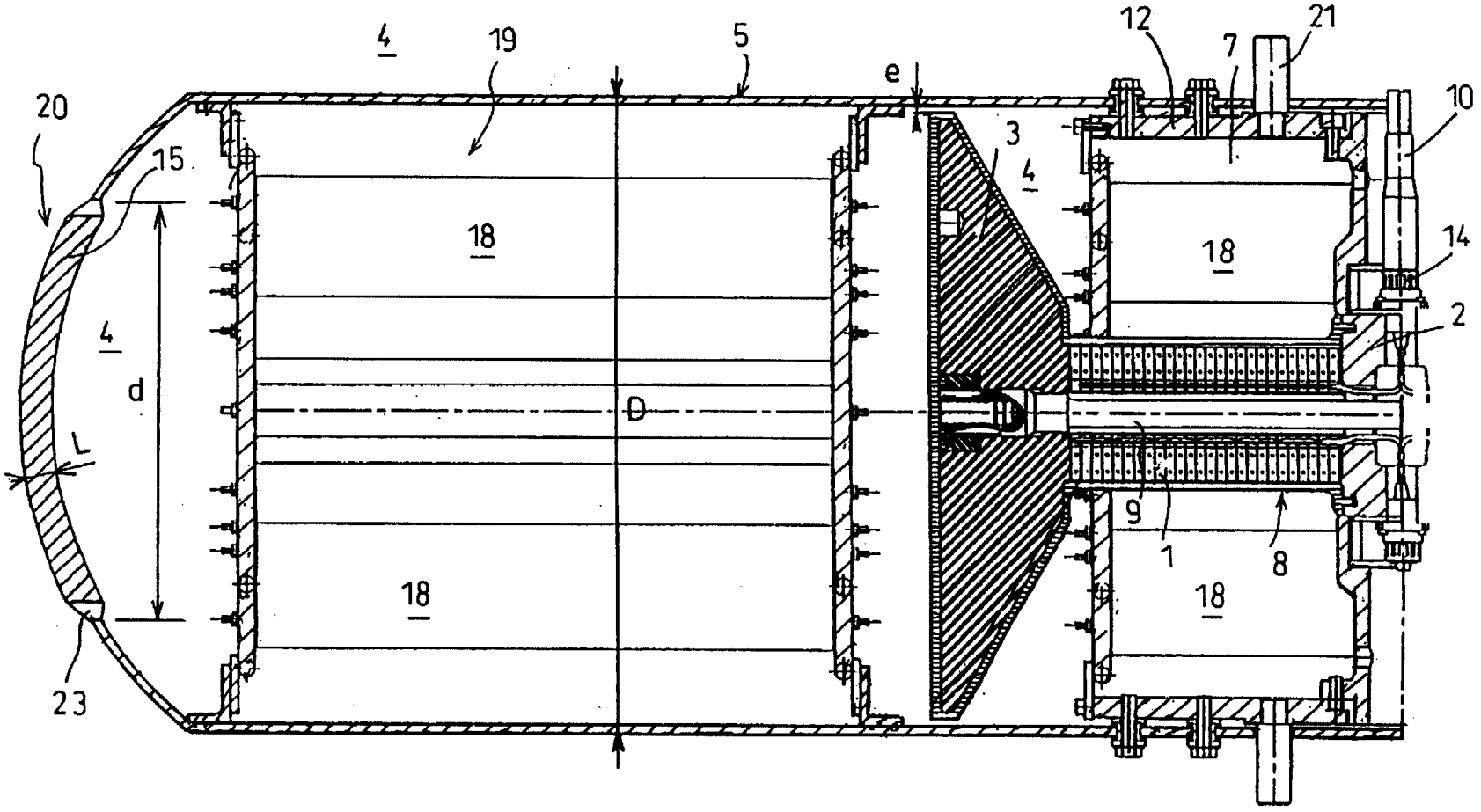
FIG. 4 is an axial cutaway view of half a transducer of the previously indicated type, with three cavities among which two are said front ones, each of them being equipped with a passive radiator according to the invention.

An internal sheath 13 isolates the preconstraint rod from the said motors 1, and an external sealing envelope 8 ensures the insulation of these motors 1 and horns 3 in relation to ambient medium 4.

the said electro-acoustic motors 1 are supplied by a feeding cable 10 fixed on the said connecting parts 11 by an electric connector 14. The embodiment of such a transducer and assembly of various connecting parts which it is made of, belong to the known domain and can be carried out by any skilled person: all the other elements which make it possible in particular to obtain the Helmholtz resonant frequency of the cavity such as indicated in the introduction, as well as the various connecting elements which improve the mechanical embodiment of the assembly are not represented here; some of them are included in other patent applications like the ones mentioned in the introduction for the so-called compliant tubes such as represented in FIG. 4.

To make it possible to fill cavity 7 with said liquid 4, the said external box 5 comprises at least one opening 6 communicating with the outside, the said opening possibly consisting of holes scattered around the cylindrical part of the box or even made of a complete circular peripheral opening.

Figure 3:
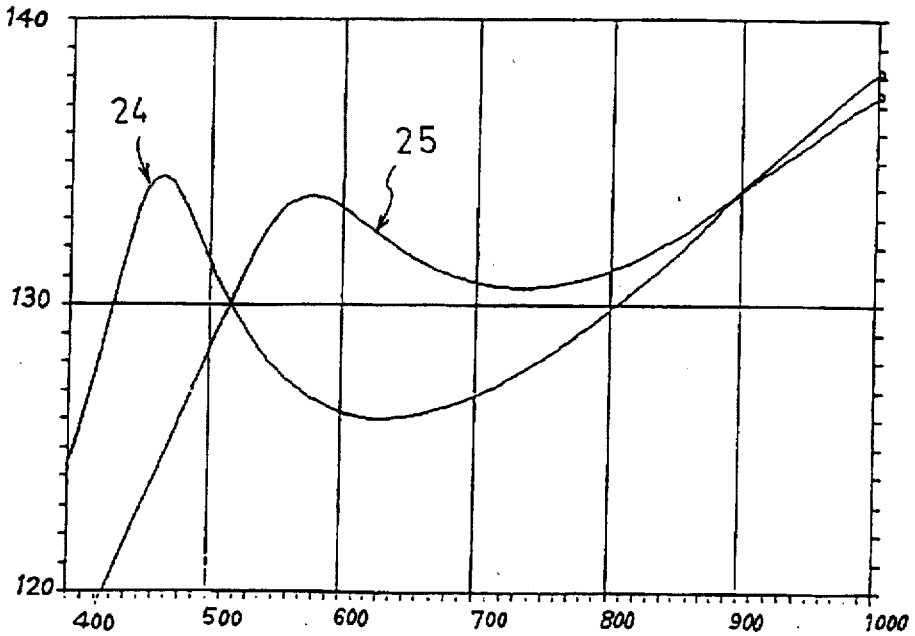
FIG. 3 represents comparative curves of acoustic power, between a standard transducer known as double "Tonpilz" and a transducer of the same type equipped with a passive radiator, in relation to the emitted frequency.

According to the present invention, the said opening or port 6, also called vent, is obturated by a passive radiator 15 made of one or more full plates having a thickness "L", made of a material denser than the said fluid 4, and hung at the periphery of the said port or vent by an elastic material 23: this or these plates constituting the said passive radiator preferably follow the shape of opening 6, 20 that they obturate and that of box 5 for which they ensure the surface continuity. The material of the plates of the said passive radiator 16 can be metal: aluminum bronze or steel, etc . . . ; if the acoustic mass of obturated vent 20 neck is thus increased in a ratio of approximately eight, the resonant frequency of the cavity is reduced such as represented in FIG. 3 and according to the equivalent acoustic mass thus obtained, it is also possible to widen the range of this resonant frequency.

Moreover, since this acoustic mass is determined by the product of the density of the material multiplied by the height of the vent neck, i.e. in the present invention thickness "L" of the plates making up the passive radiator 15, and divided by the total surface of vent 20 opening, if the material density is increased without changing the vent dimensions, a higher acoustic mass is effectively obtained; reciprocally for a same acoustic mass, if the density is increased, the surface of radiation of this vent is increased and thus the impedance of the acoustic radiation.

Figure 2:
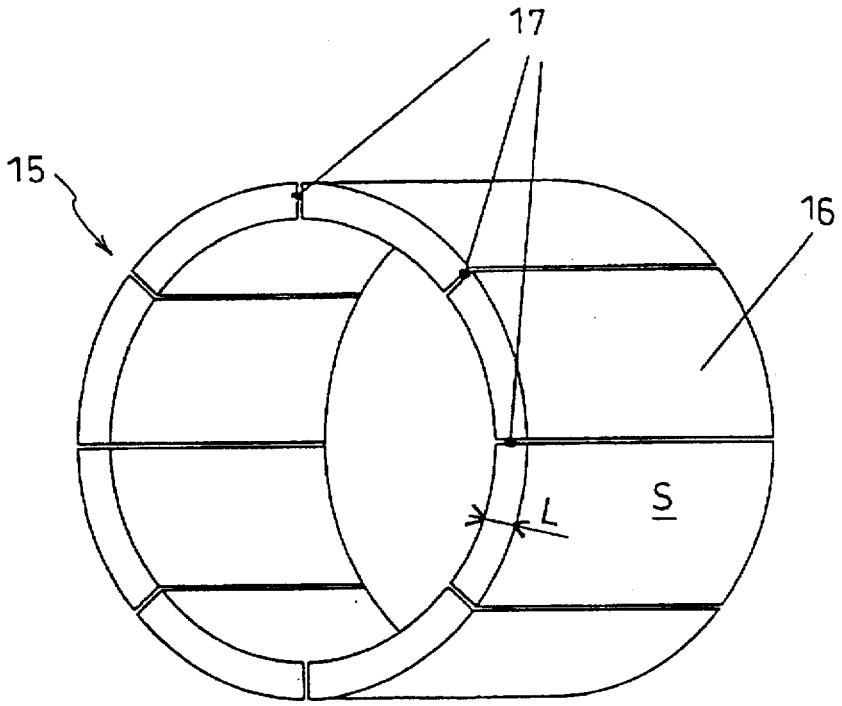
FIG. 2 is a perspective view of a passive radiator according to FIG. 1.

In case this opening 6, according to the transducer represented in FIG. 1, is peripheral and continuous, said passive radiator 15 is made of several plates or sectors 16, independent and connected to each other by elastic connections 17, such as represented in perspective in FIG. 2, on which the total surface of the cylindrical vent or opening 6 of revolution is thus obturated by eight sectors 16.

Moreover, the said transducer such as represented in dots on the left hand side of FIG. 1, can comprise a dynamic load 22 associated to each horn, solid with said box 5 and partially closing its internal section by dividing internal cavity 7 into two communicating parts, a rear one $7_1$ and a front one $7_2$, at the rear of each horn 3 and inside box 5: in the representation of FIG. 1, this means in fact dividing the whole internal cavity of the box into three cavities, among which a single rear central one $7_1$ is median and two cavities called "front" ones $7_2$ are each located behind both horns 3.

According to the representation of the dynamic load on the left hand side of the figure, the latter is made of a full wall 27 following the shape of the internal wall of box 5 with which it is solid, surrounding motor pillar 1 with at least one port 26 being drilled through which the latter passes, the said port comprises a conduit 28 extending to the rear of wall 27 in relation to horn 3 and leaving a free peripheral passage around said motor pillar 1.

Other embodiments with others conduits and ports scattered on the said wall 27 around motor pillar 1 are possible. It is necessary, specifically in this embodiment, that distance "e" between the peripheral external edge of horns 3 and the internal wall of the box be as small as possible, in any case less than 1 mm and preferably some tenths of a millimetre, in order that this space leaves little loss by leakage of fluid from cavity $7_2$ to the outside during the vibration, in order that this said fluid solicits above all the dynamic load 22 in order to thus virtually increase the mass of horn 3, and reduce, with a weight and volume equal to the latter, its emission frequency for the same power consumption.

In FIG. 3, a curve 24 of acoustic power emission of a known transducer is represented in FIG. 1 with a passive radiator according to the invention, while curve 25 represents the same transducer but not equipped with the said passive radiator, the said powers of emission being noted in relation to the frequencies in herz: it can be noted that the basic resonant frequency of approximately 580 hz is reduced by more than 100 hz for the same emission power. This was of course measured from a given type of transducer, but with other transducers, equivalent results would be obtained with the same reduction of the frequency of resonance and emission.

In another embodiment, the submersible electro-acoustic transducer such as represented in cutaway view in FIG. 4, comprises in a known manner like that of FIG. 1, two electro-acoustic motors 1, in line according to an axis XX', located on both sides of a central countermass 2 and coaxially inside a cylindrical rigid box 5 of the same axis XX', covering all the said motors 1 up to end horns 3 of the latter and itself open at both ends; cavity 7, thus delimited between and at the rear of the said horns and by the box itself, communicates with the external immersion liquid 10, by the single annular distance "e" between the internal shape of the said rigid box 5 and the peripheral edges of the ends of horns 3; this distance "e" shall be the smallest possible, either lower than 0.5 mm to avoid the liquid being pumped between the front and rear of the said horns, as in the example of FIG. 1 with dynamic load 27, despite the fact that in the present example this distance is less critical. No other means of communication or vent is made in the box other than the holes necessary for the passage of the supplying shell 10 and external fastening provisions 21, but then closed and sealed in order to avoid any acoustic loss.

According to the embodiment, said rigid box 5 extends according to its axis XX' beyond both horns 3 and constitutes with the latter two cavities 19 whose resonance corresponds to the wanted frequency of emission.

For this, said cavities 16 can contain closed elastic tubes, sealed and filled with gas, which are called compliant tubes, such as those described in patent application FR. 2.665.998 of May 5, 1988.

Moreover, in order for the cavity resonance to match the wanted frequency of emission more closely, opening 20 of the said cavities 19 to the outside have a diameter d smaller than the internal diameter D of rigid box 5; a dimensional compromise must then be found between the total dimension of the cavity, the compliant tubes or other devices such as described below, and the diameter of this opening.

In one embodiment, said cavity 7 inside said box 5 and located between both horns 3 and in which the said electro-acoustic motors I are located, can also enclose elastic tubes 18, closed, sealed and filled with gas, therefore called compliant.

The achievement of such a transducer and all the various parts which it is made of, is of the known domain and can be carried out by any skilled person without it being necessary to give more details of embodiment, such as the fastening provisions, compliant tubes and various connecting parts of the elements in relation to one another.

According to the present invention, each port 20, or axial end opening or vent, of said front cavities 19 is obturated by a passive radiator 15 made of a plate of a material having a density higher than medium 4; as previously indicated, this can be metal part either steel or aluminum bronze; this plate is hung at the periphery of the opening or vent by an elastic suspension 23, and can be bulging.

To allow a deeper immersion of this transducer, said compliant tubes 18 can be replaced in any cavity 7, 19 by at least one flexible bladder occupying at least part or even all of the volume of the concerned cavity and filled with a liquid more compressible than ambient liquid 4; this can apply either to cavity 7 or to end cavities 19, or to all the said cavities.

In fact, taking into account the presence of acoustic motors I and various parts of assembly 12 and feeder cable 10, preferably the following will be arranged in central cavity 7:

either several independent bladders, which are inserted by openings in box 5, preferably after having been filled, the said openings must then be closed to ensure the continuity of the external rigid box 5 at the level of this central cavity 7;

or a single membrane occupying at least part or even all the internal surface of cavity 7 of the transducer and made of an elastomer skin for example, and which is then filled with the said fluid, but the difficulty is then to be able to ensure the filling without leaving air bubbles which would be detrimental to the efficiency of such a device, with the depth.

Indeed, the fluid occupying the volumes delimited by the skin of the said bladders must practically fill the whole cavity as best as possible, since its volume must be in fact higher than that of represented compliant tubes 18 and such as previously described, in order to have compressibility characteristics equivalent to that of the said tubes such as they are presently used in other types of transducers.

Therefore, the compressibility of the said fluid must be in fact lower than $10^9$ N/m$^2$, defined by the product of its volumic mass $P_f$ with the square of the propagation speed of the sound in this fluid $C_f$.

Then to have the value of the global cavity compliance, the following must be obtained at the same time:

* volume of cavity 6 or 16=fluid volume+volume of residual water 10 which may exist in the corresponding cavity.

global system compliance=(fluid volume/ $P_f \times C_f^2$ of the fluid)+(water volume/ $2.22\times10^9$.

Preferably a fluid of the family of the organic compounds totally fluored of the C8H18 type is chosen; moreover, the viscosity must not be too high, that is lower than that of water, preferably less than $6.5\times10^{-7}$ m$^2$ by second which is the viscosity of silicone oil.

While this invention has been described in conjunction with the above outlined specific embodiments thereof, it is evident that many alternatives, modifications and variations will be apparent to those skilled in the art. Accordingly, the preferred embodiments of the inventions as set forth above are intended to be illustrative, not limiting. Various changes may be made without departing from the scope and spirit of the invention.

We claim:

1. A process for emitting acoustic waves into an external fluid at low frequency from a transducer comprising at least one horn solid with the end of a motor pillar, a hollow rigid box surrounding the horn and delimiting with the at least one horn at least one cavity, the at least one cavity communicating by at least one port with the external fluid and having determined dimensions and external volume, the transducer transmitting waves in a given frequency range and with a given maximum electro-acoustic power consumption, wherein:

said at least one port is obturated by a passive radiator made of a material denser than the external fluid;

said passive radiator is hung at a periphery of said at least one port by an elastic material; and acoustic waves are emitted at frequencies lower than an initial frequency range and with the maximum power consumption.

2. A process for emitting acoustic waves according to claim 1 wherein the at least one horn comprises two horns and the rigid box of the transducer is cylindrical, has a central axis, surrounds the two horns, and encloses two acoustic motors, each acoustic motor being a) associated with one of the horns, b) identical, and c) located coaxially on both sides of a central counter-mass 2, and wherein:

said rigid box extends along the axis beyond both horns thus forming two cavities, each cavity comprising one of the at least one port and having a resonance corresponding to a desired emission frequency range;

a part of the rigid box located between said horns and enclosing a central cavity is completely closed; and each of the two ports is obturated by the passive radiator.

3. A process for emitting acoustic waves according to claim 1 wherein the at least one horn comprises two horns and the rigid box of the transducer is cylindrical, has a central axis, surrounds two horns and encloses two electro-acoustic motors, each electro-acoustic motor being a) associated with one of the two horns, b) identical, and c) located coaxially on both sides of a central counter-mass, wherein:

a peripheral opening is formed in a wall of the rigid box between the two horns, thereby forming one of the at least one ports and allowing communication between said external fluid and the internal cavity located between the horns; and the peripheral opening is obturated by the passive radiator and the passive radiator is made of several sectors connected by elastic connections.

4. A device to reduce the resonant frequency of cavities of a sumbersible transducer comprising at least one horn solid with the end of a motor pillar, a hollow rigid box surrounding the horn and delimiting with the horn at least one internal cavity, the cavity communicating by at least one port with an external fluid, the internal cavity having determined dimensions and external volume, the transducer transmitting waves in a given frequency range with a given power and including a passive radiator made of a material denser than the external fluid, the passive radiator obturating the at least one port and being hung at a periphery of an edge of said at least one port by an elastic material.

5. A device according to claim 4, wherein the rigid box is cylindrical around an axis and encloses two identical electro-acoustic motors located coaxially inside the rigid box and on both sides of a central counter-mass, and opposed ends of the motors are each surrounded by a horn, the port is located between the horns, and the passive radiator is made of several independent sectors connected to each other by elastic connections.

6. A device according to claim 5, the transducer further comprising at a rear of said horn and inside the rigid box a dynamic load solid with the rigid box and partially closing an internal section of the rigid box and dividing the internal cavity into two communicating parts.

7. A device according to claim 6, characterised in that the dynamic load is made of a solid wall that follows a shape of an internal surface of the box and is solid with the box, wherein the dynamic load surrounds a motor pillar and is drilled with at least one port through which the motor pillar passes, the port comprising a conduit extending behind the solid wall in relation to the horn and leaving a free peripheral passage around said motor pillar.

8. A device according to claim 4, characterised in that the rigid box is cylindrical around an axis and encloses two identical electro-acoustic motors located coaxially in the rigid box on both sides of a central counter-mass, opposed ends of the motors are each surrounded by a horn, said rigid box extends along the axis beyond the horns and constitutes with the horns the at least one internal cavity, wherein the internal cavity has a resonance that corresponds to a desired emission frequency and comprises an axial end port obturated by a passive radiator.

9. A device according to claim 4, characterised in that the at least one internal cavity is delimited by the at least one horn and the rigid box and contains closed elastic tubes that are sealed and filled with gas.

10. A device according to claim 4, characterised in that the at least one internal cavity encloses at least one flexible bladder occupying at least part of a volume of the internal cavity, wherein the bladder is filled with a fluid more compressible than the external fluid.

* * * * *